US007000334B2

(12) United States Patent
Gillespie

(10) Patent No.: US 7,000,334 B2
(45) Date of Patent: Feb. 21, 2006

(54) SHOE OUTSOLE

(75) Inventor: Kevin H. Gillespie, Jamaica Plain, MA (US)

(73) Assignee: SRL, Inc., Wilmington, DE (US)

( * ) Notice: Subject to any disclaimer, the term of this patent is extended or adjusted under 35 U.S.C. 154(b) by 458 days.

(21) Appl. No.: 09/788,147

(22) Filed: Feb. 16, 2001

(65) Prior Publication Data

US 2002/0112374 A1 Aug. 22, 2002

(51) Int. Cl.
*A43B 13/18* (2006.01)

(52) U.S. Cl. ..... 36/28; 36/35 R; 36/37

(58) Field of Classification Search ..... 36/28, 36/35 R, 37, 29, 59 R
See application file for complete search history.

(56) References Cited

U.S. PATENT DOCUMENTS 4,724,624 A * 2/1988 Duclos ..... 36/116
4,794,707 A 1/1989 Franklin et al.
4,817,304 A 4/1989 Parker et al.
4,897,936 A * 2/1990 Fuerst ..... 36/114
5,287,638 A * 2/1994 Preston ..... 36/28
5,325,611 A * 7/1994 Dyer et al. ..... 36/30 R
5,367,791 A * 11/1994 Gross et al. ..... 36/25 R
5,718,063 A * 2/1998 Yamashita et al. ..... 36/28
5,768,806 A * 6/1998 Parisotto ..... 36/102
5,787,609 A 8/1998 Wu
5,852,886 A 12/1998 Slepian et al.
5,970,628 A 10/1999 Meschan
5,974,695 A 11/1999 Slepian et al.
6,009,637 A * 1/2000 Pavone ..... 36/28
6,023,859 A * 2/2000 Burke et al. ..... 36/100
6,026,593 A 2/2000 Harmon-Weiss et al.
6,050,001 A 4/2000 Ditrich
6,050,002 A 4/2000 Meschan
6,082,023 A 7/2000 Dalton
6,082,024 A 7/2000 DelBiondi
6,115,944 A 9/2000 Lain
6,418,641 B1 * 7/2002 Schenkel ..... 36/28

FOREIGN PATENT DOCUMENTS

BR 9800597 * 11/1999

* cited by examiner

*Primary Examiner*—Marie Patterson
(74) *Attorney, Agent, or Firm*—Fish & Richardson P.C.

(57) ABSTRACT

A shoe outsole includes a member having an upper surface, a lower surface and a heel section, the member further having at least one aperture in the heel section extending from the upper surface to the lower surface. A resilient, flexible cushion is disposed on the upper surface of the member in the heel section, the cushion being shaped to protrude through the aperture.

14 Claims, 4 Drawing Sheets

SHOE OUTSOLE

TECHNICAL FIELD

The invention relates to a shoe outsole and, in particular, to a shoe outsole for a toddler shoe having an improved cushioning system at the heel.

BACKGROUND

Young children or toddlers who are relatively new to walking preferably wear shoes that are flexible, safe and comfortable. Shoe outsoles generally have grooves in their lower surface to enhance the flexibility of the shoes. In addition, lugs or inserts may protrude from the lower surfaces to enhance the traction of the shoe outsoles with respect to the walking surface. Moreover, the heel portions of shoe outsoles continuously absorb the shock of the wearer's heels striking the ground while walking.

SUMMARY

In general, in one aspect, the invention features a shoe outsole including a member having an upper surface, a lower surface and a heel section, the member further having an aperture in the heel section extending from the upper surface to the lower surface. A resilient, flexible first cushion is disposed on the upper surface of the member in the heel section, the first cushion being shaped to protrude through the aperture.

Implementations of the invention may also include one or more of the following features. The member may include rubber or a thermoplastic resin. The member may be formed by molding.

The lower surface of the member may have a groove formed therein to enhance the flexibility of the member. The member may have a width, with the groove substantially traversing the width of the member. The member may have a perimeter, with the groove having a closed-loop shape substantially parallel to the perimeter of the member. The groove may have a substantially semi-circular shape.

The lower surface of the member and/or the upper surface of the member may have a grid pattern formed therein to enhance the flexibility of the member.

The first cushion may include a protrusion that protrudes through the aperture. The first cushion may include a polymeric gelatinous material. The first cushion may further include a flexible, resilient sheet, which may include thermoplastic urethane.

The upper surface of the member may include a recessed area for receiving the first cushion. The lower surface may further include a recessed portion disposed around the aperture. Moreover, the member may include a plurality of apertures.

The member may include a sidewall along the heel section of the member, the sidewall including a cut-out portion. The cut-out portion may be a slit. A second cushion may be disposed in the member adjacent to the cut-out portion. The second cushion may be capable of protruding through the cut-out portion.

In general, in another aspect, the invention features a shoe outsole including a member having an upper surface, a lower surface, a heel section, and a sidewall along the heel section, the member further having an aperture in the heel section extending from the upper surface to the lower surface and a cut-out portion in the sidewall. A resilient, flexible cushion is disposed on the upper surface of the member in the heel section, the cushion being shaped to protrude through the aperture and to protrude through the cut-out portion.

In general, in another aspect, the invention features a shoe including an upper and an outsole permanently fixed to the upper. The outsole includes a member having an upper surface, a lower surface and a heel section, the member further having an aperture in the heel section extending from the upper surface to the lower surface. A resilient, flexible cushion is disposed on the upper surface of the member in the heel section, the cushion being shaped to protrude through the aperture.

An advantage of the present invention is that the outside with the heel cushioning system mimics a toddler's natural walking motion.

A further advantage of the present invention is that shoes may be constructed with enhanced flexibility and comfort for the wearer.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
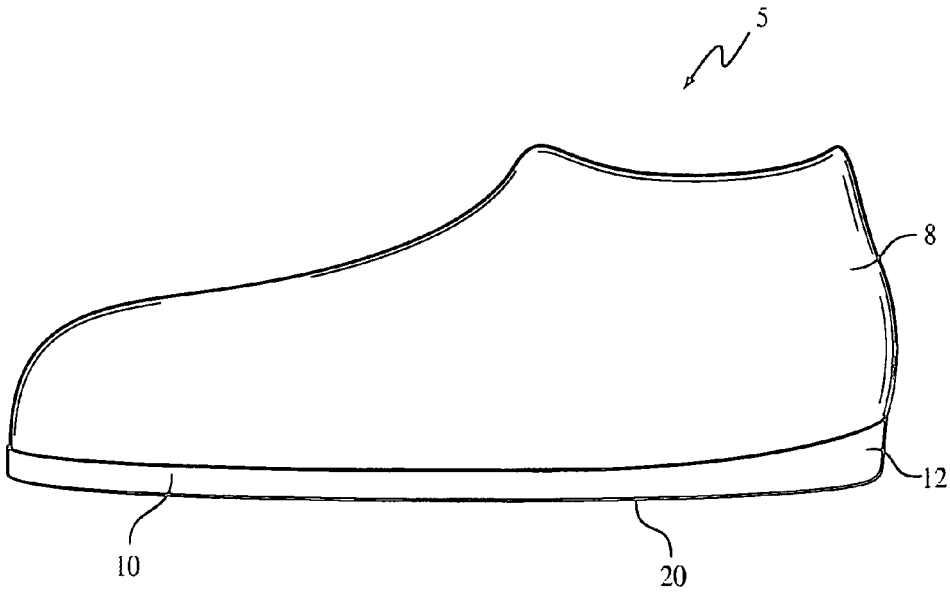
FIG. 1 is a side view of a shoe.
Figure 2:
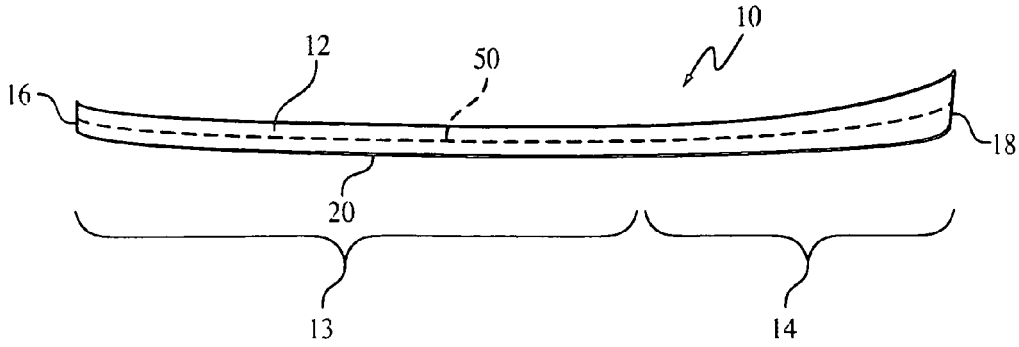
FIG. 2 is a side view of an outsole.

Referring to FIGS. 1 and 2, a shoe 5 includes an upper 8 and an outsole 10. Upper 8 is made from, e.g., leather, canvas, or other suitable material.

Outsole 10 has a lower surface 20, an upper surface 50, and an upwardly extending sidewall 12. The outsole includes a forefoot section 13, generally corresponding to the area of the wearer's foot from the ball of the foot to the ends of the toes, and a heel section 14, generally corresponding to the area of the wearer's heel. Outsole 10 may also include a front wall 16 at the toe end of the outsole and a rear wall 18 at the heel end of the outsole. Rear wall 18 curves from a horizontal to a vertical plane, which facilitates the wearer's maintaining his or her balance while walking.

Outsole 10 is made from, e.g., a rubber or a thermoplastic resin, and may be formed in a mold. Outsole 10 generally has a thickness of about 4.5 mm. The outsole dimensions given below are for a typical child's shoe (U.S. size 8) having an overall length of about 180 mm and an overall width of about 80 mm.

Figure 3:
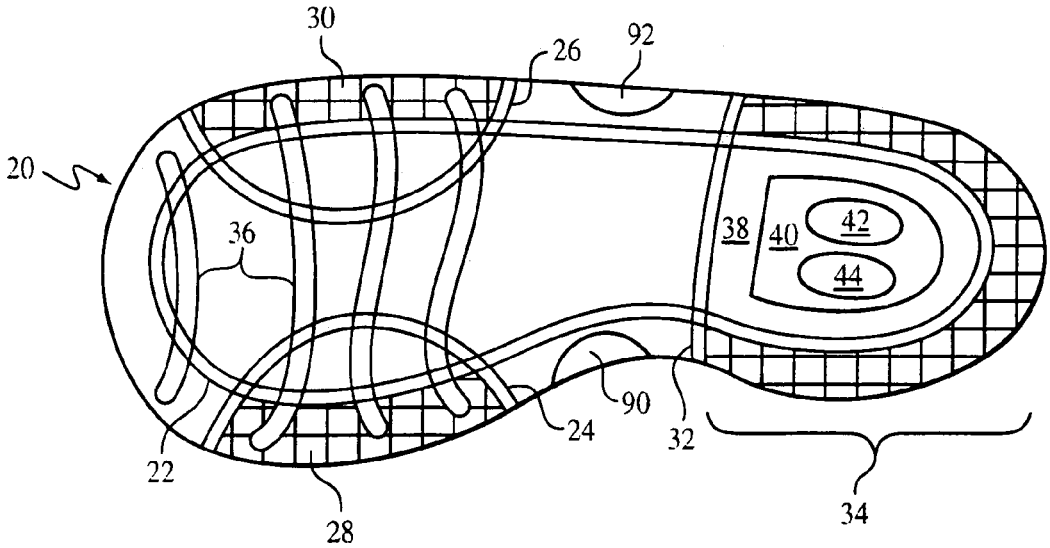
FIG. 3 is a plane view of the lower surface of the outsole of FIG. 2.

As shown in FIG. 3, lower surface 20 of outsole 10 may include a set of contoured arch regions 90, 92 that correspond to the arches of the foot of the shoe's wearer and that are spaced from the ground when walking. Lower surface 20 may also include a series of grooves and grids formed in or on the lower surface. The grooves and grids enhance the flexibility of outsole 10 in various directions, particularly along the lower surface, which allows the outsole to move, flex and stretch along with the wearer's foot during walking. All of the features of the lower surface of the outsole may be formed in the rubber used to make the outsole at the time it is molded.

In particular, a groove 22 having the shape of a closed loop generally mimics the shape of and is parallel to the outer edge of the outsole. Groove 22 increases the flexibility of the outsole along its perimeter. Grooves 24 and 26 in the forefoot section 13 are generally semi-circular in shape, extending from one side edge of the outsole to the same side edge under the balls of the wearer's foot, and define left and right side portions 28 and 30, respectively. Grooves 24 and 26 enhance the side-to-side flexibility of the outsole. Groove 32 defines a heel portion 34 under the heel of the wearer's foot. Groove 32 enhances the front-to-back flexibility of the outsole between heel section 14 and forefoot section 13. Each of grooves 22, 24, 26 and 32 has a width of about 1.0 mm to 1.5 mm and a depth of approximately 3 mm in lower surface 20.

Left and right side portions 28 and 30 and heel portion 34 may also have grid shapes cut into or imprinted thereon to further enhance the flexibility of these respective portions. Series of perpendicular lines forming the grid shapes may be cut into the outsole at a depth of approximately 1 mm. Alternatively, series of perpendicular lines forming the grid shapes may be raised on the lower surface of the outsole at a height of approximately 1 mm above the lower surface of the outsole.

Outsole 10 may also include a set of substantially parallel, transverse grooves 36 extending across the width of, but not reaching the edges of, the outsole. Transverse grooves 36 enhance the front-to-back flexibility of the outsole along forefoot section 13. Although four grooves 36 are shown in FIG. 3, there may be any number of such grooves, or no grooves. Grooves 36 are spaced approximately 14 mm from each other. The length of each groove is in the range of approximately 60 mm.

Alternatively, and in addition, the lower surface of the outsole may include transverse grooves that extend across the entire width of the outsole from one edge to the other. The lower surface may also have formed thereon one or more raised ridges, which increase the traction of the outsole during walking.

Heel portion 34 of outsole 10 may include a central portion 38, which may further include a recessed portion 40. Recessed portion 40 has a depth of approximately 3 mm above lower surface 20. The outsole has apertures 42 and 44 formed within recessed portion 40. Apertures 42 and 44 extend from lower surface 20 to upper surface 50 of outsole 10. As shown in FIG. 3, apertures 42 and 44 have an oval shape, but the apertures may have any shape. Also, there may be one or more apertures within heel portion 34.

Figure 5:
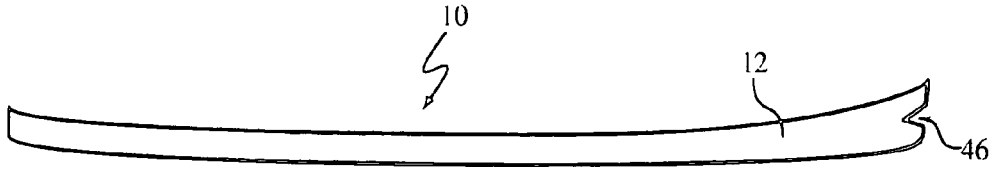
FIG. 5 is a side view of the outsole of FIG. 2 with a cut-out portion in the heel section.
Figure 6:
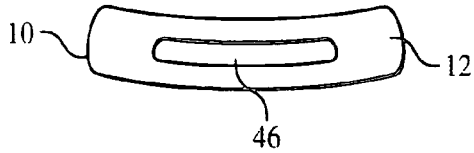
FIG. 6 is a back view of the outsole of FIG. 5.

As shown in FIGS. 5 and 6, sidewall 12 of outsole 10 along heel section 14 may include a cut-out portion 46 in the form of a window or slot.

Figure 4:
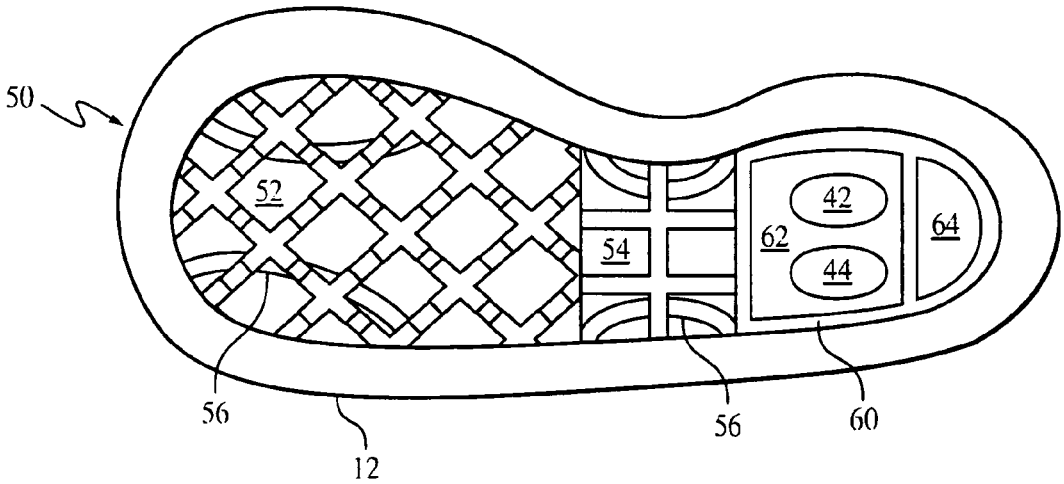
FIG. 4 is a plane view of the upper surface of the outsole of FIG. 2.

As shown in FIG. 4, upper surface 50 of outsole 10 within sidewall 12 may include a series of grooves and grids formed in or on the upper surface. The grooves and grids enhance the flexibility of outsole 10 in various directions, which further allow the outsole to move, flex and stretch along with the wearer's foot during walking. All of the features of the upper surface of the outsole may be formed in the rubber used to make the outsole at the time it is molded.

Upper surface 50 may include a first forward portion 52 having a series of crossed lines forming a grid. The lines are raised over the upper surface. However, the raised lines do not necessarily have a uniform height, with the height of the lines being lower between the crossing points of the lines. The height of the raised lines above the upper surface may vary between about 2 mm to about 3 mm. This arrangement enhances the flexibility of the outsole in various directions across the upper surface. Upper surface 50 may also include a second forward portion 54 having a grid with a different orientation than the grid of first forward portion 52. The grid of second forward portion 54 enhances the flexibility of the outsole from front-to-back and side-to-side, but necessarily not to the same extent as the grid of the first forward portion. The upper surface may also include a series of curved ridges 56 corresponding to the deep grooves 22, 24, 26, 32 formed in the lower surface of the outsole.

Upper surface 50 includes a rear heel portion 60 having recessed areas 62 and 64. Recessed area 62 is shaped to receive a cushion 70 (FIG. 7), described below. Apertures 42 and 44 extend from the upper surface within recessed area 62 to the lower surface of the outsole. Recessed area 64 extends to the rearmost portion of the outsole to sidewall 12 containing cut-out portion 46.

Figure 7:
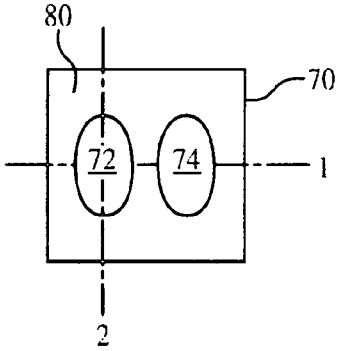
FIG. 7 is a plane view of the cushion of the present invention.
Figure 8:
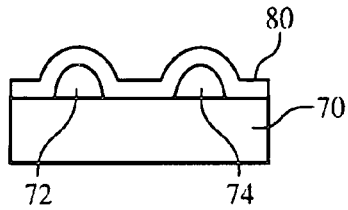
FIG. 8 is a side view of the cushion of FIG. 7 along axis 1.
Figure 9:
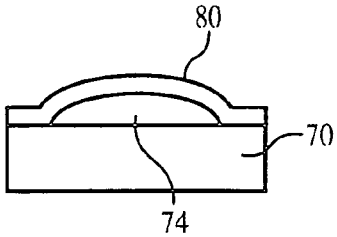
FIG. 9 is a side view of the cushion of FIG. 7 along axis 2.

As shown in FIGS. 7, 8 and 9, cushion 70 is shaped to be received in recessed area 62 in the upper surface of the outsole. Cushion 70 includes protrusions 72 and 74 having approximately the same shape and size as apertures 42 and 44 and positioned so that when the cushion is placed in recessed area 62, the protrusions extend through the apertures into recessed portion 40 of the outsole.

Cushion 70 is designed to absorb at least a portion of the shock generated by the wearer's heel striking the ground during walking. Cushion 70 may be made from a soft, polymeric gelatinous material, e.g., polyurethane gel. Cushion 70 is preferably a solidified gelatinous material that will not leak and that is non-toxic. Alternatively, cushion 70 may have a covering in the form of a flexible, resilient sheet 80 that protects the cushion from debris encountered during normal wear. Sheet 80 may be a thermoplastic urethane sheet approximately 0.25 mm thick.

As the wearer walks, the material of cushion 70 flows and deforms, and is pushed slightly through apertures 42 and 44. Since recessed portion 40 on lower surface 20 of outsole 10 is spaced from the ground, the portion of cushion 70 protruding through apertures 42 and 44, even when force is applied to the cushion, does not contact the ground. As the pressure from the heel strike lessens, the material of cushion 70 retracts and flows back into recessed area 62 of upper surface 50, until cushion 70 returns to its original, relaxed state within the recessed portion. The extent that cushion 70 protrudes through apertures 42 and 44 depends on the wearer's weight and the force of the heel strike.

Figure 10:
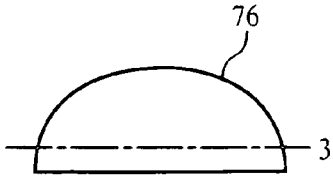
FIG. 10 is a plane view of another cushion of the present invention.
Figure 11:
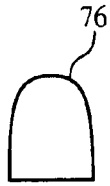
FIG. 11 is a side view of the cushion of FIG. 10 along axis 3.

FIGS. 10 and 11 show another cushion 76 that may be placed within recess 64. Cushion 76 is shaped to extend along and protrude outwardly from cut-out portion 46 in sidewall 12 along heel section 14. Cushion 76 may be made from the same material and function in the same manner as cushion 70.

Cushion 76 may also flow out of cut-out portion 46 during heel strike, further reducing the shock generated by the heel strike. However, the amount of cushion 76 that protrudes through cut-out portion 46 will be minimal, since there is little rearward force generated during heel strike. The exposed portion of cushion 76 through cut-out portion 46 predominately acts as a window to see and feel cushion 76.

Figure 12:
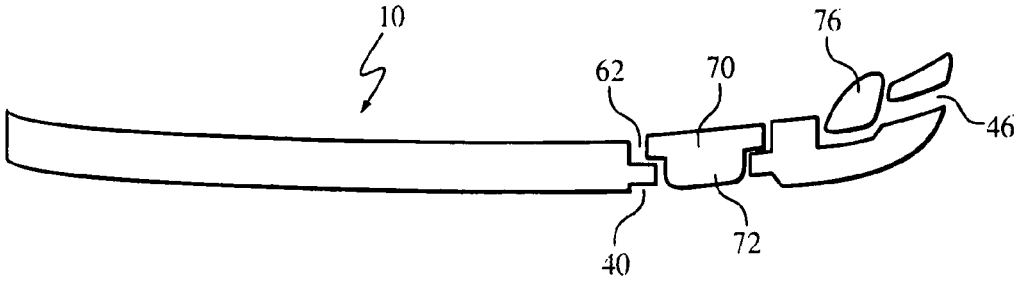
FIG. 12 is a cut-away, side view of the outsole of FIG. 2 with the cushions positioned therein.
Figure 13:
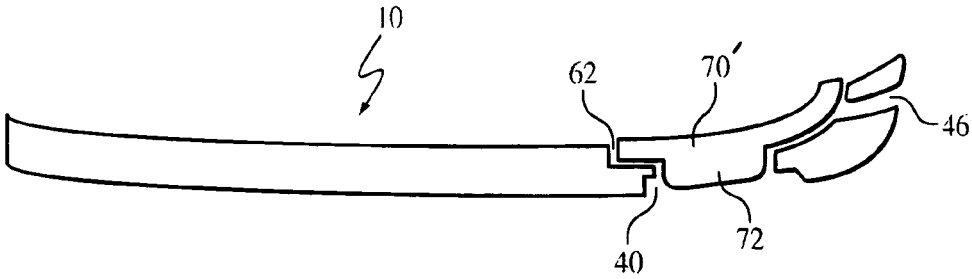
FIG. 13 is a cut-away, side view of an alternative embodiment of the outsole of FIG. 2 with the cushioned positioned therein.

FIG. 12 shows the positions of cushions 70 and 76 placed in outsole 10. Alternatively, as shown in FIG. 13, cushions 70 and 76 may be formed as a single cushion 70' from a unitary piece of material, which is bent to extend over both apertures 42 and 44 and cut-out portion 46.

The shoe 5 is formed by placing cushions 70 and 76 within recessed areas 62 and 64, respectively, placing upper 8 over upper surface 50 of outsole 10 within sidewall 12, and then permanently fixing the upper to the outsole.

A number of embodiments of the invention have been described. Nevertheless, it will be understood that various modifications may be made without departing from the spirit and scope of the invention. For example, while the invention is described for a toddler shoe, the concept will work equally as well in an adult shoe. Accordingly, other embodiments are within the scope of the following claims.

What is claimed is:

1. A shoe comprising:

an outsole having an upper surface, an opposite lower surface, and a heel section, the upper surface being positioned relatively closer to a wearer's foot and the lower surface being positioned to engage upon a floor or ground surface when the shoe is worn during walking, the lower surface of the outsole having at least one groove formed therein to enhance the flexibility of the outsole, the outsole further defining an aperture in the heel section extending from the upper surface to the opposite lower surface; and a resilient, deformable first cushion disposed in said aperture, with an upper cushion surface of said first cushion disposed at a region of the upper surface of the outsole in the heel section and a lower cushion surface of said first cushion exposed at a region of the lower surface of the outsole in the heel section, said first cushion being adapted to deform and flow toward the floor or ground surface under the wearer's weight and force of heel strike, and the outsole having a perimeter, and at least one of said at least one groove having a closed-loop shape substantially parallel to the perimeter of the outsole, the outsole, further comprising a recessed wall surface extending generally upwards from the lower surface toward the upper surface and defining a recessed region in communication, at its upper reaches, with said aperture, said lower cushion surface of said first cushion, exposed at the aperture within said recessed region, being spaced by said recessed wall surface of said outsole above the floor or ground surface at all times, including when said first cushion deforms and flows under the wearer's weight and force of heel strike.

2. A shoe comprising:

an outsole having an upper surface, an opposite lower surface, and a heel section, the upper surface being positioned relatively closer to a wearer's foot and the lower surface being positioned to engage upon a floor or ground surface when the shoe is worn during walking, the lower surface of the outsole having a grid pattern formed therein to enhance the flexibility of the outsole, the outsole further defining an aperture in the heel section extending from the upper surface to the opposite lower surface; and a resilient, deformable first cushion disposed in said aperture, with an upper cushion surface of said first cushion disposed at a region of the upper surface of the outsole in the heel section and a lower cushion surface of said first cushion exposed at a region of the lower surface of the outsole in the heel section, said first cushion being adapted to deform and flow toward the floor or ground surface under the wearer's weight and force of heel strike, and the outsole further comprising a recessed wall surface extending generally upwards from the lower surface toward the upper surface and defining a recessed region in communication, at its upper reaches, with said aperture, said lower cushion surface of said first cushion, exposed at the aperture within said recessed region, being spaced by said recessed wall surface of said outsole above the floor or ground surface at all times, including when said first cushion deforms and flows under the wearer's weight and force of heel strike.

3. The shoe according to claim 2, wherein the upper surface of the outsole has a grid pattern formed therein to enhance the flexibility of the outsole.

4. A shoe comprising:

an outsole having an upper surface, an opposite lower surface, and a heel section, the upper surface being positioned relatively closer to a wearer's foot and the lower surface being positioned to engage upon a floor or ground surface when the shoe is worn during walking, the outsole further defining an aperture in the heel section extending from the upper surface to the opposite lower surface; and a resilient, deformable first cushion disposed in said aperture, with an upper cushion surface of said first cushion disposed at a region of the upper surface of the outsole in the heel section and a lower cushion surface of said first cushion exposed at a region of the lower surface of the outsole in the heel section, said first cushion comprising a polymeric gelatinous material, and said first cushion being adapted to deform and flow toward the floor or ground surface under the wearer's weight and force of heel strike, and the outsole further comprising a recessed wall surface extending generally upwards from the lower surface toward the upper surface and defining a recessed region in communication, at its upper reaches, with said aperture, said lower cushion surface of said first cushion, exposed at the aperture within said recessed region, being spaced by said recessed wall surface of said outsole above the floor or ground surface at all times, including when said first cushion deforms and flows under the wearer's weight and force of heel strike.

5. A shoe comprising:

an outsole having an upper surface, an opposite lower surface, and a heel section, the upper surface being positioned relatively closer to a wearer's foot and the lower surface being positioned to engage upon a floor or ground surface when the shoe is worn during walking, the outsole further defining an aperture in the heel section extending from the upper surface to the opposite lower surface; and a resilient, deformable first cushion disposed in said aperture, with an upper cushion surface of said first cushion disposed at a region of the upper surface of the outsole in the heel section and a lower cushion surface of said first cushion exposed at a region of the lower surface of the outsole in the heel section, said first cushion being adapted to deform and flow toward the floor or ground surface under the wearer's weight and force of heel strike, the outsole further comprising a recessed wall surface extending generally upwards from the lower surface toward the upper surface and defining a recessed region in communication, at its upper reaches, with said aperture, said lower cushion surface of said first cushion, exposed at the aperture within said recessed region, being spaced by said recessed wall surface of said outsole above the floor or ground surface at all times, including when said first cushion deforms and flows under the wearer's weight and force of heel strike; and the outsole further comprising a sidewall along the heel section of the outsole, the sidewall including a cut-out portion.

6. The shoe according to claim 5 wherein the cut-out portion is a slot.

7. The shoe according to claim 5 further comprising a second cushion disposed in the outsole adjacent to the cut-out portion.

8. The shoe according to claim 7 wherein the second cushion deforms and flows outwardly at the cut-out portion during heel strike.

9. A shoe comprising:

an outsole having an upper surface, a lower surface, a heel section, and a sidewall along the heel section, the outsole further defining an aperture in the heel section extending from the upper surface to the lower surface and a cut-out portion in the sidewall;

a resilient, deformable first cushion disposed in said aperture, with an upper cushion surface of said first cushion disposed at a region of the upper surface of the outsole in the heel section and a lower cushion surface of said first cushion exposed at a region of the lower surface of the outsole in the heel section; and a resilient, deformable second cushion disposed on the upper surface of the outsole in the heel section, said first cushion being adapted to deform and flow toward the floor or ground surface under the wearer's weight and force of heel strike, and said second cushion being shaped to deform outwardly at the cut-out portion; and the outsole further comprising a recessed wall surface extending generally upwards from the lower surface toward the upper surface and defining a recessed region in communication, at its upper reaches, with said aperture, said lower cushion surface of said first cushion, exposed at the aperture within said recessed region, being spaced by said recessed wall surface of said outsole above the floor or ground surface at all times, including when said first cushion deforms and flows under the wearer's weight and force of heel strike.

10. The shoe outsole according to claim 9 wherein the first cushion includes a protrusion that protrudes at the aperture.

11. A shoe comprising:

an outsole having an upper surface, an opposite lower surface, and a heel section, the upper surface being positioned relatively closer to a wearer's foot and the lower surface being positioned to engage upon a floor or ground surface when the shoe is worn during walking, the outsole further defining an aperture in the heel section extending from the upper surface to the opposite lower surface; and a resilient, deformable first cushion disposed in said aperture, with an upper cushion surface of said first cushion disposed at a region of the upper surface of the outsole in the heel section and a lower cushion surface of said first cushion exposed at a region of the lower surface of the outsole in the heel section, the first cushion comprising a polymeric, gelatinous material;

said first cushion being adapted to deform and flow toward the floor or ground surface under the wearer's weight and force of heel strike;

the upper surface including a recessed region disposed around the aperture, for receiving the first cushion; and the outsole further comprising a recessed wall surface extending generally upwards from the lower surface toward the upper surface and defining a recessed region in communication, at its upper reaches, with said aperture, said lower cushion surface of said first cushion, exposed at the aperture within said recessed region, being spaced by said recessed wall surface of said outsole above the floor or ground surface at all times, including when said first cushion deforms and flows under the wearer's weight and force of heel strike.

12. The shoe according to claim 11 wherein the outsole further comprises a sidewall along the heel section of the outsole, the sidewall including a cut-out portion.

13. The shoe according to claim 12 further comprising a second cushion disposed in the outsole adjacent to the cut-out portion.

14. The shoe according to claim 13 wherein the second cushion deforms and flows outwardly at the cut-out portion during heel strike.

* * * * *